US007779730B2

(12) United States Patent
Jones

(10) Patent No.: US 7,779,730 B2
(45) Date of Patent: Aug. 24, 2010

(54) HAND-OPERATED MULTI-FUNCTION TOOL

(76) Inventor: Grant Jones, 2920 Capazo Ct., Carlsbad, CA (US) 92009

( * ) Notice: Subject to any disclaimer, the term of this patent is extended or adjusted under 35 U.S.C. 154(b) by 36 days.

(21) Appl. No.: 12/074,746

(22) Filed: Mar. 7, 2008

(65) Prior Publication Data

US 2008/0307584 A1 Dec. 18, 2008

Related U.S. Application Data

(60) Provisional application No. 60/944,740, filed on Jun. 18, 2007.

(51) Int. Cl.
*B25C 3/00* (2006.01)
*B25F 1/00* (2006.01)
*B67B 7/44* (2006.01)

(52) U.S. Cl. ..... 81/44; 7/151; 7/166

(58) Field of Classification Search ..... 81/23, 81/24; 7/151, 152, 166, 167, 168
See application file for complete search history.

(56) References Cited

U.S. PATENT DOCUMENTS 2,230,376 A * 2/1941 Cullen ..... 7/144
3,987,828 A * 10/1976 Matheis ..... 81/24
5,988,020 A * 11/1999 Johnson ..... 81/23
6,332,376 B1 * 12/2001 Hurley ..... 81/23
D497,087 S 10/2004 Gallo et al.
7,269,868 B1 * 9/2007 Allin ..... 7/143

* cited by examiner

*Primary Examiner*—Hadi Shakeri
(74) *Attorney, Agent, or Firm*—Morland C. Fischer

(57) ABSTRACT

A multi-function hand-operated tool that is compact in size and of light weight so as to be carried and used to perform a variety of different jobs by carpenters, painters, do-it-yourselfers, and the like. The tool includes a nail set to transmit a driving force to the head of a nail to cause the nail to be countersunk in a work surface. An open mouth which is sized to receive the cap on a bottle cooperates with a lip that applies a rotational force to remove the cap from the bottle. A nail extractor having a cavity in which to surround and capture the head of a nail transmits a pulling force to the nail head to cause the nail to be removed from a work surface. A channel having a flush-mounted magnet carries a nail to be positioned in upstanding alignment against a work surface so that the nail can be driven therein. A pair of spaced, outwardly projecting teeth are located between a lid and a can to pry the lid off the can. A chalk line is tied to the tool, and the teeth can be either staked in a work surface or located over and against an edge of the work surface so that a chalk mark can be made along the work surface. The teeth are spaced from one another so as to engage and lift a hinge pin from a hinge to which the pin is coupled.

7 Claims, 6 Drawing Sheets

HAND-OPERATED MULTI-FUNCTION TOOL

CROSS-REFERENCE TO RELATED APPLICATIONS

This application is related to Provisional Patent Application No. 60/944,740 filed Jun. 18, 2007.

BACKGROUND OF THE INVENTION

1. Field of the Invention

This invention relates to a lightweight, hand-operated, multi-function tool that is of compact size so as to be easily carried in a toolbox, automotive glove compartment or a pocket of a workman for use by carpenters, painters, do-it-yourselfers, and the like.

2. Background Art

Tools have long been used to simplify jobs at work sites out in the field or around the house. Even simple jobs may require a variety of different tools. In the event that different jobs are to be completed one after another, the workman may require access to a corresponding number of different tools. In some cases, the workman may forget to carry a particular tool that is needed for the job. In other cases, the workman may have to carry a relatively heavy and cumbersome toolbox in which an assortment of tools are transported from place to place. Accordingly, what would be desirable is a single, lightweight, compact tool that is convenient to carry and capable of completing a series of jobs so as to avoid the necessity of having to carry around many different tools to perform the same number of jobs.

SUMMARY OF THE INVENTION

Briefly, and in general terms, a lightweight, hand-operated, multi-function tool is disclosed to be used by a workman to complete a variety of jobs at home and in the field in substitution of a number of tools that is otherwise commonly required to complete the same number of jobs. The multi-function tool of the present invention is compact in size so as to easily fit within a toolbox, an automotive glove compartment, or a pocket of the workman. By virtue of its versatility, the multi-function tool herein disclosed can be used by carpenters, painters, do-it-yourselfers, and the like.

A gripping handle is located at one end of the multi-function tool. The primary working end of the tool lies opposite the handle. Projecting downwardly from the bottom of the handle is a nail set to be positioned against the head of a nail that has been hammered into a work surface. A driving force applied by the nail set against the nail head causes the nail to be countersunk in the work surface in response to a striking force applied to the working end of the tool. A mouth is formed in the working end of the multi-function tool in which to receive the cap of a bottle. The mouth cooperates with a tapered lip that is positioned inwardly of the mouth to engage and pull the cap off the bottle in response to a rotational force applied to the tool at the handle.

A nail extractor having a pocket formed therein projects forwardly from the working end of the multi-function tool to remove a small nail that protrudes from a work surface. The extractor receives and captures the head of the nail via an inlet notch formed in the pocket. A pulling force applied to the handle of the tool is transferred to the pocket at which a corresponding pulling force is exerted on the head for causing the nail to be removed from the work surface. Located above the nail extractor at the working end of the multi-function tool is a laterally-extending groove or channel having a magnet recessed therein. A nail is magnetically retained within the channel so that a striking force can be applied to the nail head to drive the nail into the work surface without subjecting the workman's fingers to possible injury.

A pair of spaced teeth having tapered tips project rearwardly from the working end of the multi-function tool. The tips of the teeth can be positioned under the lid of a can, such that a rotational force applied to the handle of the tool is transferred to the teeth to cause the lid to be pried off the can. The tips of the teeth can also be used as spikes to bite into a work surface so that a chalk line tied to the tool can be used to make a chalk mark along the work surface. In the alternative, the teeth can also be located over the top and against an edge of the work surface to establish a hook for a chalk line that is tied to the tool and once again used to make a chalk mark along the work surface. In this same regard, the teeth of the tool are spaced from one another to receive therebetween the shaft of a hinge pin, such that the head of the pin is seated upon the teeth. An upward striking force applied to the bottom of the handle is transferred to the teeth at which a pushing force is exerted on the head for lifting the hinge pin out of an associated hinge.

DESCRIPTION OF THE PREFERRED EMBODIMENT

Figure 1:
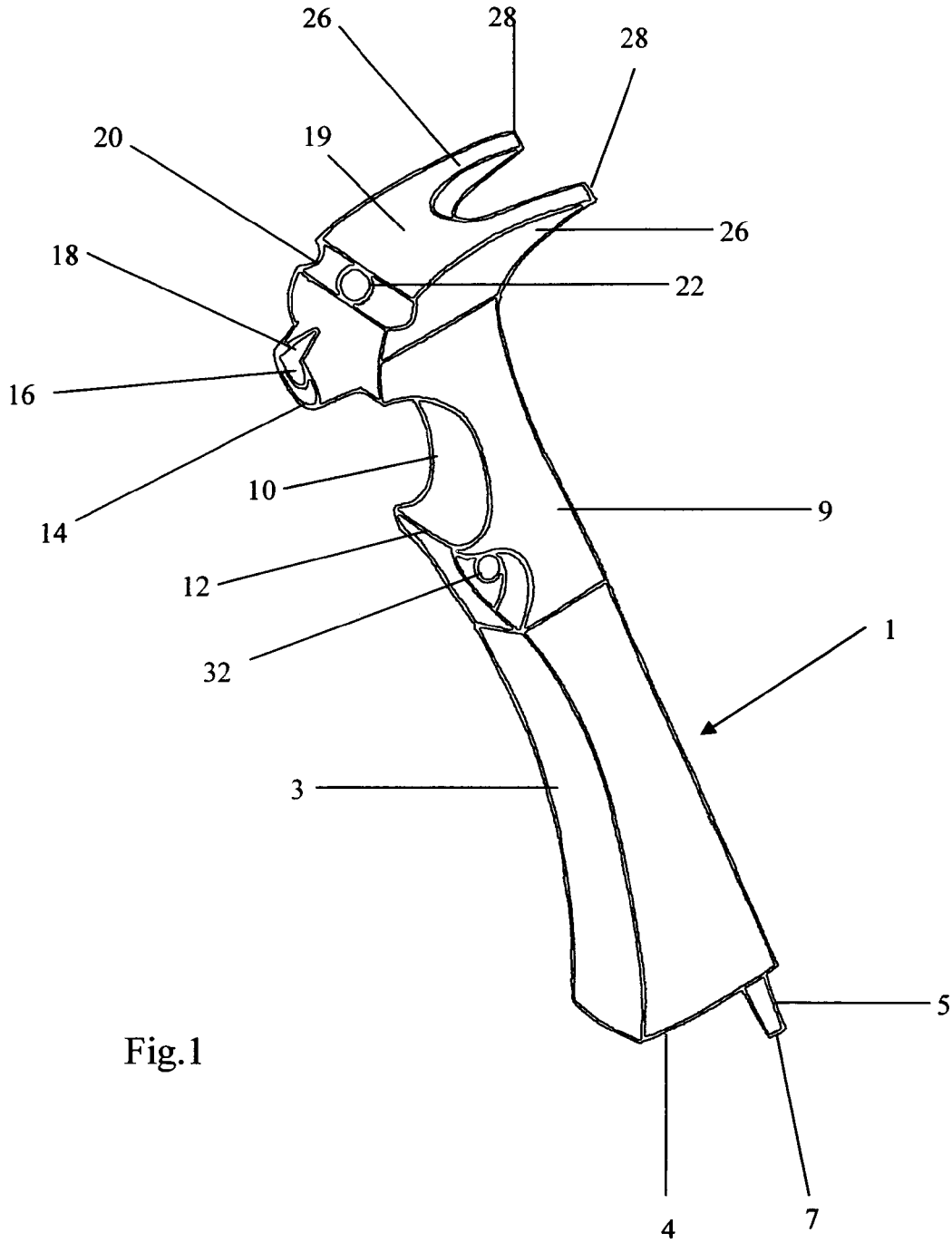
FIG. 1 is a perspective view of a hand operated multi-function tool according to a preferred embodiment of this invention.
Figure 2:
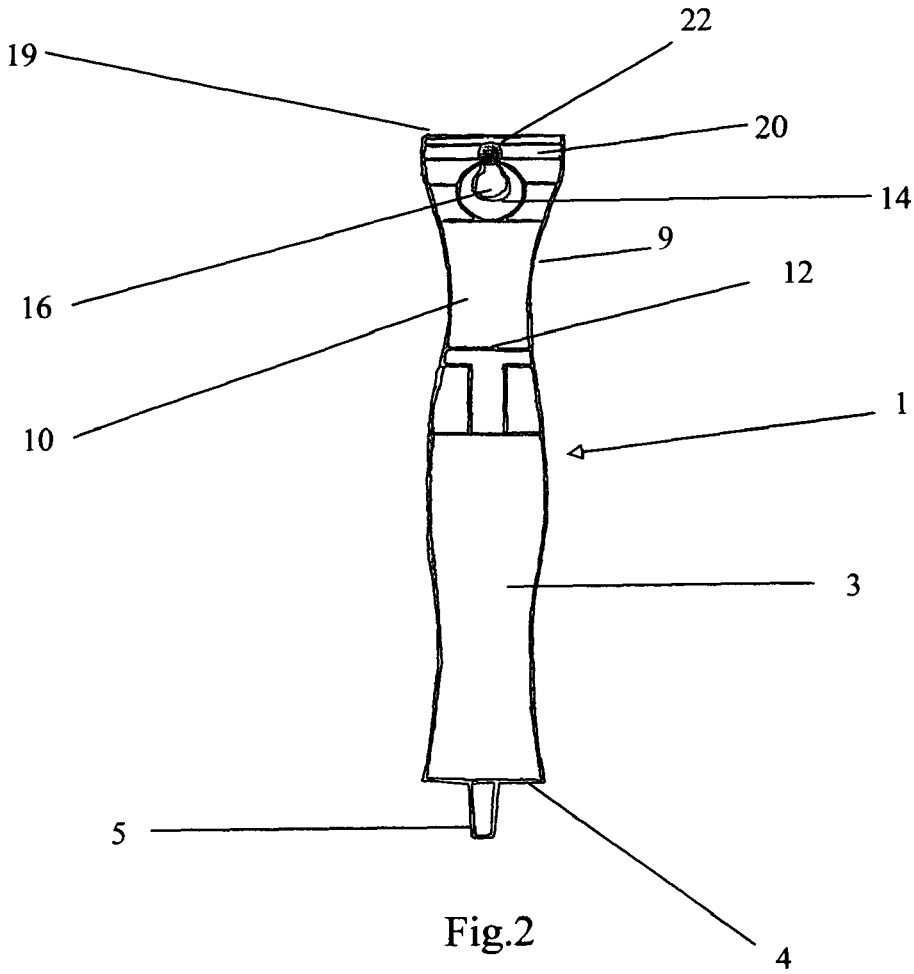
FIG. 2 is a front view of the multi-function tool of FIG. 1.
Figure 3:
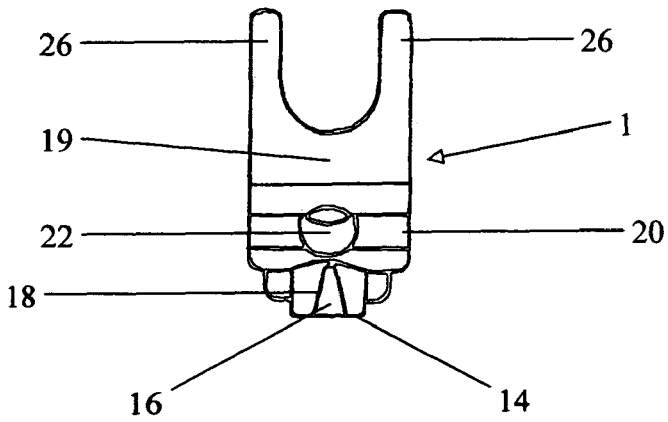
FIG. 3 is a top view of the multi-function tool of FIG. 1.

An overview of the hand-operated, multi-function tool 1 according to a preferred embodiment of the present invention is initially described while referring concurrently to FIGS. 1 to 3 of the drawings. As will soon become apparent, the multi-function tool 1 is ideal for use by carpenters, painters, do-it-yourselfers, and the like to complete jobs in the field and at home. To this end, the multi-function tool 1 is compact (about six inches long) and lightweight so as to conveniently fit in a small storage drawer and be easily and conveniently transported in a toolbox, automotive glove compartment, or a pocket of a workman.

The multi-function tool 1 includes a gripping handle 3 at one end thereof. The handle 3 is sized and shaped to fit within the hand of the user. Projecting downwardly from the bottom 4 of handle 3 is a generally conical nail set 5. As will be described later while referring to FIG. 4, the outward end of nail set 5 includes a cavity 7 that can be positioned against the head of a nail that has been hammered into a work surface. A striking force applied to a striking surface 19 at the top of the working end 9 of the tool 1 opposite the handle 3 is transferred through the nail set 5 to the head of the nail for causing the nail to be countersunk in the work surface.

A generally arcuate recess or open mouth 10 extends inwardly at the front of the working end 9 of the multi-function tool 1. A tapered lip 12 projects upwardly into the mouth 10 from the working end 9 at the bottom of the mouth 10. As will be later described when referring to FIG. 5, the mouth 10 formed in the working end 9 of tool 1 is sized to receive therewithin the cap of a bottle. A rotational force applied by the workman to the tool 1 at the handle 3 is imparted to the lip 12 to move lip 12 into contact with and generate a corresponding force by which to remove the cap from the bottle so that the contents of the bottle might then be consumed.

A generally cylindrical nail extractor 14 projects forwardly from the front of the working end 9 of the multi-function tool 1. A pocket 16 (best shown in FIG. 2) lies within the nail extractor 14. The pocket 16 is sized to receive therewithin and capture an accessible head of a small nail, such as a finish nail, that protrudes from a work surface. The nail enters the nail extractor 14 via a relatively narrow inlet notch 18 that communicates with the pocket 16. As will be described while referring to FIG. 6, an outward pulling force applied by the workman to the handle 3 of the tool 1 is transferred from the nail extractor 14 to the head of the nail captured within the pocket 16 so that the nail can be removed from the work surface.

Located above the nail extractor 14 near the top 19 of the working end 9 of the multi-function tool 1 is a laterally-extending groove or channel 20. A small flush-mounted magnet 22 (best shown in FIG. 2) is recessed within the channel 20. Channel 20 is shaped to receive therewithin the elongated body of a nail such that the nail body and the channel 20 are aligned parallel with one another. By virtue of the magnet 22, the nail body will be magnetically retained within the channel 20. As will be described while referring to FIG. 7, the tool 1 can hold an upstanding nail that is carried within the channel 20 against a work surface to enable a striking force to be applied by the workman against the nail head to drive the nail into the work surface. In this manner, the workman's fingers need not hold the nail against the work surface so as to advantageously avoid the possibility of injury from the striking force applied to the nail head.

Projecting rearwardly from the striking surface 19 at the top of the working end 9 of the multi-function tool 1 in perpendicular alignment with the handle 3 are a pair of outstretched teeth 26. The teeth 26 are disposed in spaced, parallel alignment with one another. Although a pair of teeth 26 are shown and described, a single tooth (not shown) projecting rearwardly from the striking surface 19 may be substituted for the pair of teeth shown. Each tooth 26 is preferably tapered towards a relatively narrow tip 28. The teeth 26 are advantageously capable of different applications.

First, and as will be described when referring to FIG. 8, the multi-function tool 1 can be manipulated to locate the narrow tips 28 of the teeth 26 below the lid of a can to be opened. A rotational force applied to the handle 3 by the workman is translated into a corresponding rotational force generated by the teeth 26, whereby to pry the lid off the can.

As will be described when referring to FIG. 9A, the tips 28 of the teeth 26 of tool 1 can also be used as spikes to bite into a work surface. In this case, the tool 1 establishes a stake to which a chalk line that is pulled from a chalk line reel can be tied. The chalk line is held above the work surface so that a chalk mark may be applied thereto. In the alternative, and as will be described while referring to FIG. 9B, rather than using the teeth 26 as spikes to stake the tool 1, the outstretched teeth 26 can also be positioned to lie over and against an edge of the work surface to establish a hook to hold the chalk line above the work surface so that a chalk mark can be applied thereto.

What is even more, the pair of teeth 26 are spaced from one another so as to accommodate the shaft of a hinge pin therebetween. In this case, the relatively wide head of the hinge pin will be seated upon the teeth 26. Thus, the space between teeth 26 must be larger than the diameter of the pin shaft but smaller than the diameter of the pin head. As will be described while referring to FIG. 10, an upward striking force applied by the workman to the bottom 4 of the handle 3 is transferred through the working end 9 to the teeth 26 to apply a corresponding upward pushing force against the head of the hinge pin, whereby to lift the hinge pin out of an associated (e.g., door) hinge.

A (e.g., cylindrical) utility hole 32 runs laterally through the working end 9 of the multi-function tool 1. The hole 32 is sized to receive therethrough any one of a string, a chain or a ring. Thus, the aforementioned chalk line (best shown in FIGS. 9A and 9B) that is pulled from a chalk line reel can be tied to the tool 1 through hole 32. In this same regard, a key chain, ring, or the like can be coupled to the tool 1 at the auxiliary hole 32 so that small, easy-to-lose items (e.g., a key) can be carried with the tool.

Figure 4:
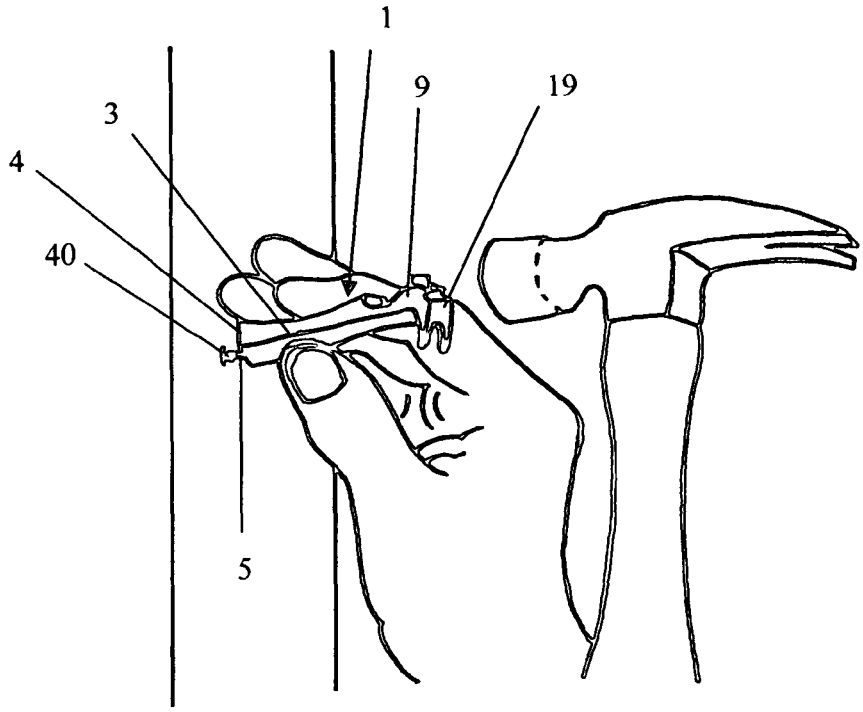
FIG. 4 shows a nail set of the multi-function tool being used to countersink a nail in a work surface.

Use of the multi-function tool 1 of this invention to perform any one or more of a variety of different jobs is now described while referring to FIGS. 4-10 of the drawings. Turning first to FIG. 4, the multi-function tool 1 is turned upside down while the workman grasps the handle 3. The nail set 5 projecting from the bottom 4 of handle 3 is positioned against the head 40 of a nail that has been hammered into a work surface. A striking force applied by a hammer, or the like, to the striking surface 19 at the top of the working end 9 of tool 1 is transferred through handle 3 and nail set 5 to the head 40 of the nail, whereby to cause the nail to be countersunk in the work surface.

Figure 5:
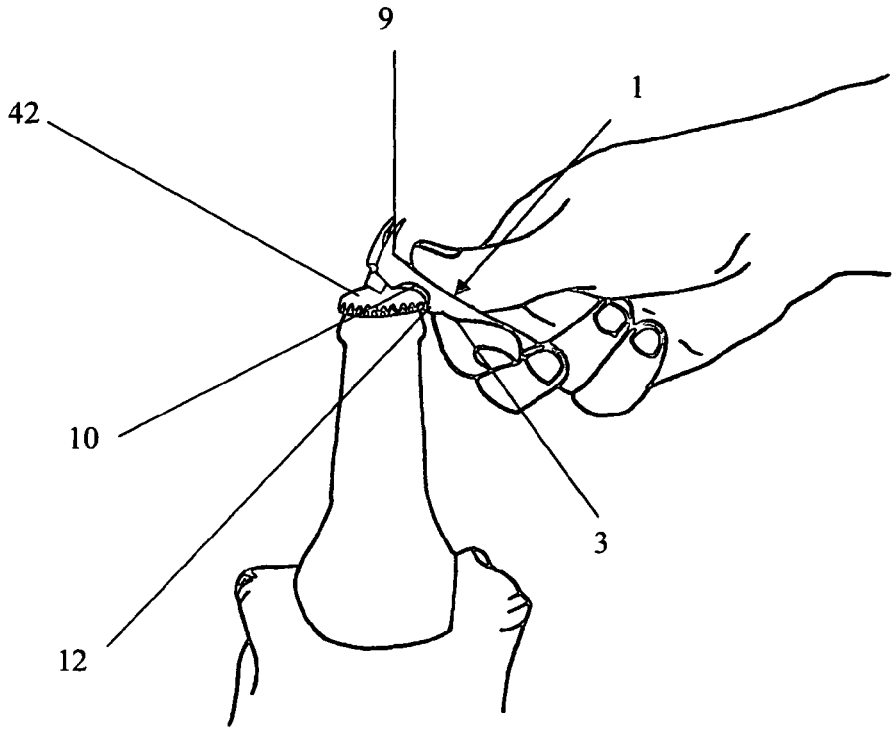
FIG. 5 shows an open mouth and a tapered lip of the multi-function tool cooperating to remove a cap from a bottle.

Referring now to FIG. 5, the multi-function tool 1 is used to remove a cap 42 from a bottle to permit access to the contents thereof. While holding the bottle in one hand, the workman grasps the handle 3 of tool 1 in the other hand and positions the open mouth 10 at the working end 9 of tool 1 in surrounding engagement with the bottle cap 42. With the tapered lip 12 which projects into the mouth 10 lying below the cap 42, a rotational force applied by the workman to the handle 3 is imparted to lip 12 by which to force the cap 42 off the bottle.

Figure 6:
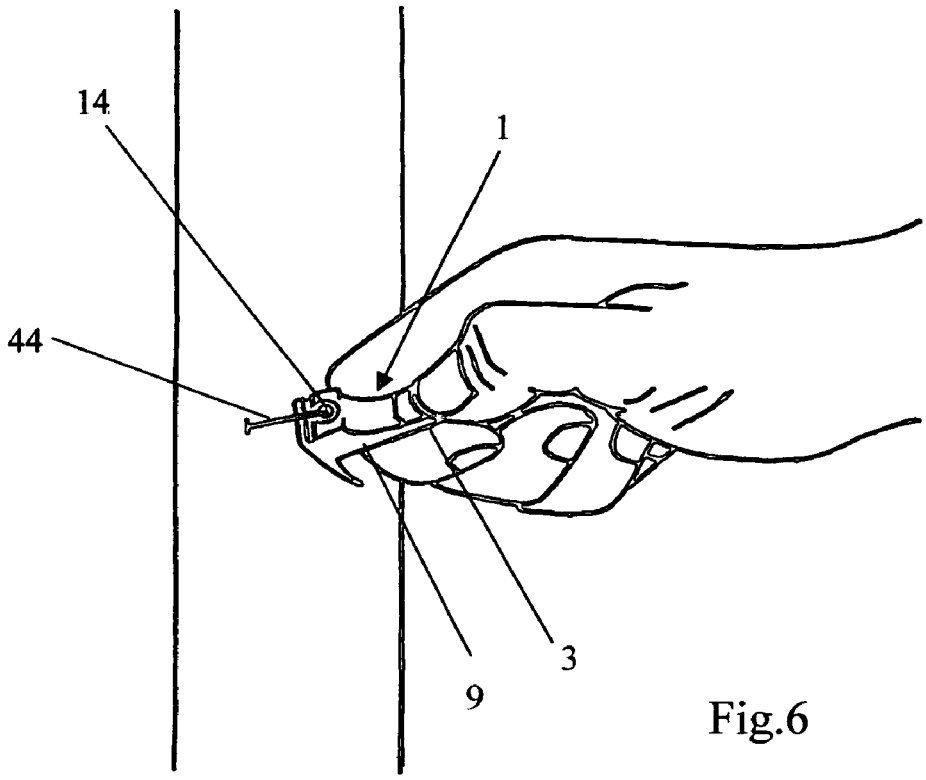
FIG. 6 shows a nail extractor of the multi-function tool being used to remove a nail from a work surface.

In FIG. 6, the multi-function tool 1 is used to remove a small partially-driven nail 44, the head of which is accessible above a work surface. While grasping the handle 3 of tool 1 in his hand, the working end 9 is positioned such that the head of the nail 44 is located in and captured by the pocket 16 of nail extractor 14 via the inlet notch 18 (best shown in FIG. 1). An outward pulling force applied by the workman to the handle 3 of tool 1 is transferred to the extractor 14 and to the head of the nail 44 within the pocket 16 of extractor 14, whereby to cause the nail 44 to be removed from the work surface.

Figure 7:
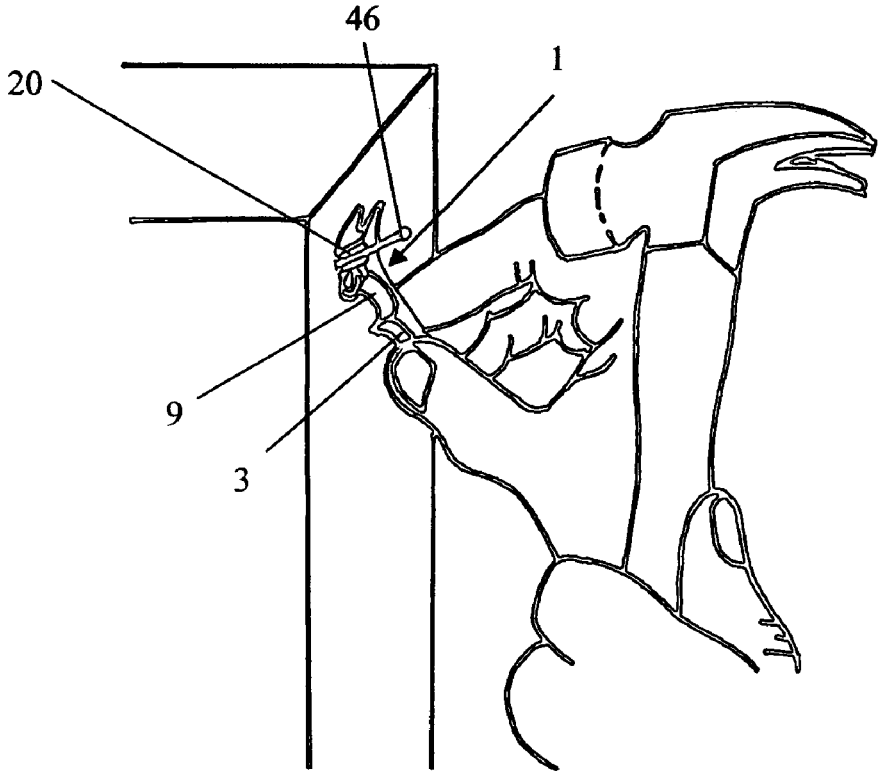
FIG. 7 shows a channel with a recessed magnet of the multi-function tool being used to hold and position an upstanding nail to be driven into a work surface.

FIG. 7 shows the multi-function tool 1 being used to hold a nail 46 in upstanding alignment against a work surface so that the nail can be driven into the surface without subjecting the workman's fingers to possible injury. While grasping the handle 3 of tool 1 in his hand, the body of a nail 46 is positioned in the laterally-extending channel 20 at the working end 9 of tool 1. Because of the magnet (designated 22 and best shown in FIG. 1) that is recessed in channel 20, the nail 46 will be retained therein. The tool 1 is turned on its side, and the nail 46 carried in channel 20 is moved in upstanding alignment against the working surface. A striking force applied by a hammer, or the like, to the head of the upstanding nail 46 will cause the nail to be partially driven into the work surface with the workman's fingers out of the way of the hammer. The tool 1 is now removed so that the nail 46 can be driven completely into the work surface.

Figure 8:
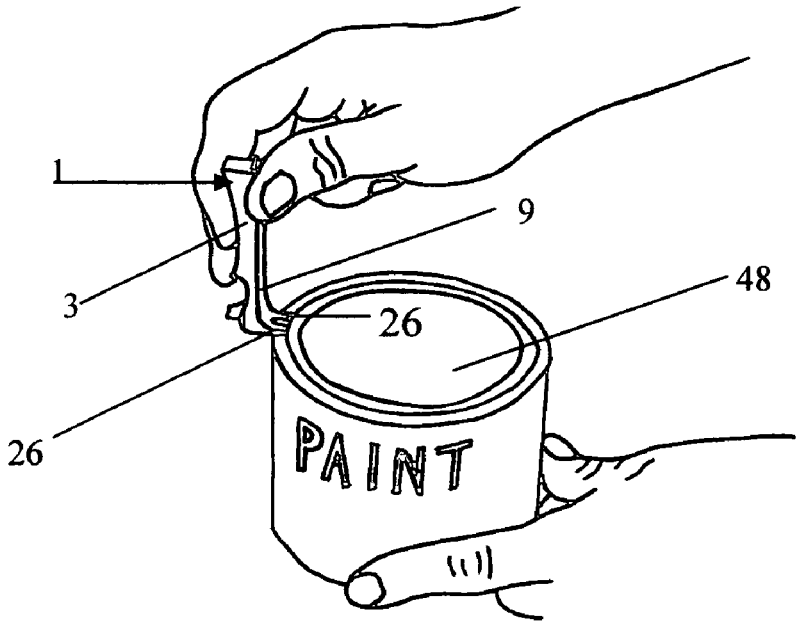
FIG. 8 shows a pair of teeth of the multi-function tool being used to pry a lid off a can.

Turning to FIG. 8, the multi-function tool 1 is shown being used to remove a lid 48 from a can. While grasping the handle 3 of tool 1 in his hand, the pair of spaced teeth 26 projecting from the striking surface 19 at the working end 9 of the tool are moved into contact with the can such that the tips (designated 28 and best shown in FIG. 1) of teeth 26 are located between the can and the lid 48. A rotational force applied by the workman to the handle 3 of tool 1 is imparted through the working end 9 to the teeth 26 and the tips 28 thereof to cause the lid to be pried off and separated from the can.

Figure 9A:
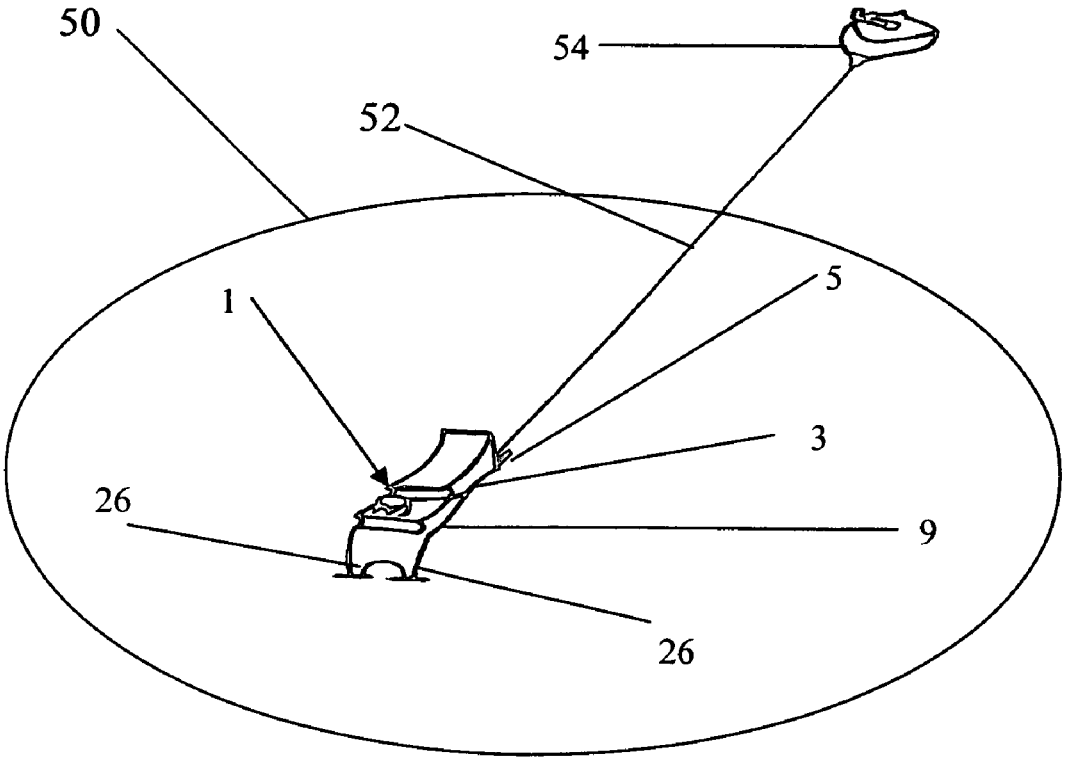
FIG. 9A shows the pair of teeth of FIG. 8 being used to bite into a work surface to establish a stake to which a chalk line from a chalk line reel can be tied for making a chalk mark along the work surface.
Figure 9B:
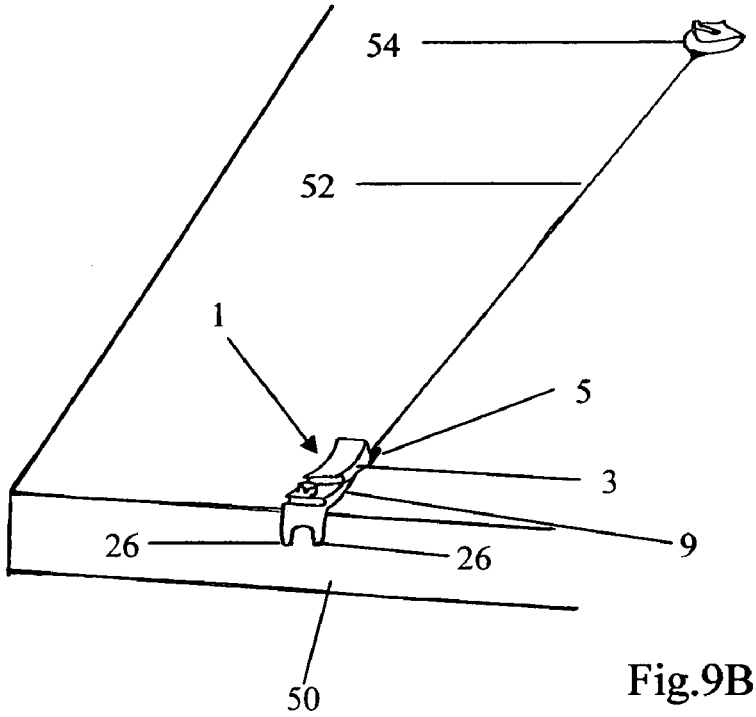
FIG. 9B shows the pair of teeth of FIG. 9A being located over and against the edge of the work surface to establish a hook to which the chalk line from the chalk line reel can be tied.

FIGS. 9A and 9B show the pair of spaced teeth 26 of the multi-function tool 1 being used to perform jobs which differ from that described while referring to FIG. 8. In the case of FIG. 9A, the tool 1 is forced by the workman downwardly against a work surface 50, such that the tips 28 of teeth 26 form spikes that bite into the work surface to anchor the tool 1 on the work surface. A chalk line 52 that is pulled from a chalk line reel 54 to run above the work surface 50 can be attached to tool 1 to enable a chalk mark to be made along the work surface. The chalk line 52 may be wrapped around tool 1 or tied to the tool through the auxiliary hole (designated 32 in FIG. 1). Instead of using the teeth 26 to anchor the tool 1 on the work surface 50, the tool may be turned on its end and the previously-described nail set 5 used as a spike that is driven into the work surface to create an anchor to which the chalk line 52 is tied.

Rather than using the teeth 26 or nail set 5 as spikes to anchor the tool against a work surface, FIG. 9B shows the teeth 26 of the multi-function tool 1 lying over the top of and against an edge of the work surface 50 to create a hook for holding the tool on the work surface. The chalk line 52 from the chalk line reel 54 can be attached to the tool in the manner described above so that a chalk mark can be made along the work surface 50.

Figure 10:
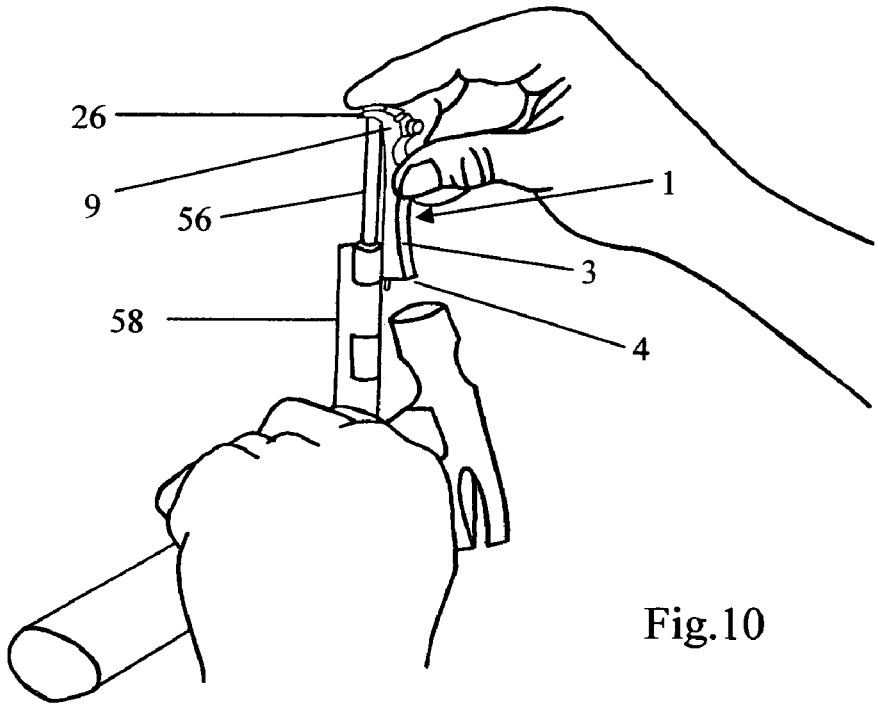
FIG. 10 shows the pair of teeth of FIG. 8 being used to engage and push a hinge pin upwardly and out of an associated hinge.

Yet another application for the pair of spaced teeth 26 which project from the striking surface 19 at the top of the working end 9 of the multi-function tool 1 is shown in FIG. 10. In this case, the teeth 26 are moved into surrounding engagement with the shaft of a hinge pin 56 that is coupled to a hinge 58 of the kind commonly located between a door and a door frame. Thus, the shaft of the hinge pin 56 is received in the space between the teeth 26, and the head of pin 56 is seated on top of the teeth 26. A striking force applied by a hammer, or the like, to the bottom 4 of handle 3 is transferred through the working end 9 to teeth 26, whereby to cause the hinge pin 56 to be pushed upwardly and out of the hinge 58 to which the hinge pin is coupled.

The invention claimed is:

1. A multi-function tool, comprising:

a head located at the top of said tool and a handle located opposite said head at the bottom of said tool at which said tool is grasped in the hand of a user;

a nail set projecting in a first direction from the bottom of said handle to be moved into contact with the head of a first nail and to receive an impact force for driving the first nail into a first work surface;

a nail extractor extending from said head in a second direction and having a cavity in which to surround and capture the head of a second nail extending from a second work surface and to receive a pulling force for causing the second nail to be removed from the second work surface;

a channel running across said head in a third direction in which to receive and carry a third nail so that the third nail can be positioned in upstanding alignment against a third work surface so that the third nail can be driven into the third work surface without the user's fingers having to hold the third nail; and a pair of teeth being spaced from one another by a distance which is greater than the diameter of a door hinge pin and smaller than the diameter of the head of the door hinge pin, said pair of teeth extending from said head in a fourth direction so as to lie in perpendicular alignment with said handle such that an impact force delivered to the bottom of said handle is transferred to said teeth by way of said handle to generate a force sufficient to lift the head of the door hinge pin, the first direction of said nail set lying perpendicular to each of said second direction, said third and said fourth direction.

2. The multi-function tool recited in claim 1, further comprising an open mouth extending inwardly of said tool and a lip projecting into said mouth, said mouth being sized to receive therewithin a cap on a bottle and said lip being aligned to engage the bottle cap, such that a rotational force applied to said handle is transmitted to said lip to cause said lip to move into engagement with and remove the cap from the bottle.

3. A multi-function tool having a handle at one end at which the tool is grasped in the hand of a workman and a head at the opposite end, said tool comprising:

a pair of teeth being spaced from one another and projecting from said head in a first direction so as to lie in perpendicular alignment with said handle;

a nail extraction pocket projecting from said head in an opposite second direction and having an inlet opening formed therethrough, said nail extraction pocket being sized to surround and capture the head of first nail received therein by way of said inlet opening, a pulling force applied to said handle being transmitted to said head at which to exert a corresponding pulling force on said nail extraction pocket and the head of the first nail captured therein; and a channel located between said pair of teeth at one side thereof and said nail extraction pocket at the opposite side thereof, said channel running laterally across said head in a third direction and being sized to receive the body of a second nail therewithin so as to hold the second nail against a work surface so that the third nail can be driven into the work surface without the workman having to use his fingers to hold the second nail.

4. The multi-function tool recited in claim 3, wherein said pair of teeth and said nail extraction pocket are axially aligned with one another at opposite ends of said head, and said channel runs across said head so as to lie in perpendicular alignment with respect to the axial alignment of said pair of teeth and said nail extraction pocket.

5. The multi-function tool recited in claim 3, further comprising a magnet carried by said head at which to attract and hold the second nail within said channel so that the second nail can be held against the work surface without use of the workman's fingers.

6. The multi-function tool recited in claim 3, further comprising a nail set projecting from said handle and being sized to contact the head of a third nail for imparting an impact force to said head in response to a corresponding impact force applied to the head of said tool.

7. The multi-function tool recited in claim 3, wherein there is a space between said pair of teeth projecting from said head, said space being larger than the diameter of a door hinge pin and smaller than the diameter of the head of the door hinge pin, such that an impact force delivered to the bottom of said handle is transferred to said teeth by way of said handle to generate a force sufficient to lift the head of the door hinge pin.

* * * * *